United States Patent [19]

Gartner et al.

[11] 3,968,667

[45] July 13, 1976

[54] COMBINATION LOCK CONSTRUCTION

[75] Inventors: Klaus W. Gartner, Downey; Tim M. Uyeda, San Gabriel, both of Calif.; Steven Helesfai, Rochester, N.Y.

[73] Assignee: Sargent & Greenleaf, Inc., Nicholasville, Ky.

[22] Filed: July 2, 1975

[21] Appl. No.: 592,671

[52] U.S. Cl. ..... 70/303 A; 70/333 R

[51] Int. Cl.[2] ..... E05B 37/08

[58] Field of Search ..... 70/303 A, 302, 333 R

[56] References Cited

UNITED STATES PATENTS

| | | | |
|---|---|---|---|
| 2,925,726 | 2/1960 | Miller | 70/302 |
| 3,045,467 | 7/1962 | Herlong | 70/303 A |
| 3,176,486 | 4/1965 | Richardson | 70/303 A |

FOREIGN PATENTS OR APPLICATIONS

| | | | |
|---|---|---|---|
| 705,729 | 7/1952 | United Kingdom | 70/303 A |

*Primary Examiner*—Paul R. Gelian
*Assistant Examiner*—Kenneth J. Dorner
*Attorney, Agent, or Firm*—Mason, Fenwick & Lawrence

[57] ABSTRACT

A combination lock of the type having peripherally gated tumbler wheels rotating about a common axis and adjusted by a rotatable dial and driving cam assembled on a spindle and supported for axial as well as rotary movement, the lock has an over-center spring coupled to a fence lever which normally holds the fence lever at a raised inactive position and has a fence lever accelerator which includes an anvil surface portion and a hammer portion supported by a spring formation which is stressed to an energy storage position responsive to rotation of the driving cam so that the hammer portion can be released from that position to impact against the anvil surface and impel the fence lever toward the driving cam to cause the fence lever to shift to a lowered coupled condition with the driving cam if the tumbler wheels are properly aligned and to cause it to be spring returned to the raised inactive position if they are not properly aligned.

17 Claims, 7 Drawing Figures

COMBINATION LOCK CONSTRUCTION

BACKGROUND OF THE INVENTION

The present invention relates in general to combination locks, and more particularly to combination locks having means incorporated therein for resisting surreptitious entry techniques of manipulation of the lock by unauthorized persons.

Conventional locks of the class known as combination locks usually comprise three tumbler wheels which are loosely journalled in coaxial, side-by-side spaced relation for rotation within a lock casing on a tubular arbor or tumbler post projecting inwardly from the front wall of the casing. The lock dial, which usually has one hundred peripheral calibration marks thereon, is affixed to a dial spindle which extends through the bore of the tumbler post and has keyed to the inner end thereof a disc-like drive cam which is likewise arranged coaxially with and spaced rearwardly from the tumbler wheels. A drive pin projects forwardly from the drive cam and has a lost motion connection through a conventional fly with the rearmost tumbler wheel to drive the tumbler wheel in selected relation to the drive cam. A similar lost motion connection is provided between each of the successive tumbler wheels so that each of the tumbler wheels may be driven upon predetermined rotation of the drive cam. Each of the tumbler wheels and the drive cam is provided with a peripheral notch or gate at a selected radial position on the drive cam and tumbler wheels.

A fence lever which is pivotally connected near one end to a reciprocative bolt slidably supported in the lock casing is provided with a depending nose near the opposite end which is designed to ride upon the drive cam periphery, in conventional combination locks, and has a bar or fence projecting laterally from the fence lever in overlying relation with the peripheries of the tumbler wheels. The position of the fence in relation to the length of the fence lever nose is usually such that the fence is spaced slightly from the peripheries of the tumbler wheels when the fence lever nose is riding on the drive cam periphery.

In such a conventional combination lock construction, when the tumbler wheel gates are out of registry with the fence and the dial is turned to the proper position to dispose the drive cam gate below the fence lever nose, the fence lever nose will drop slightly into the drive cam gate until the fence bears upon the tumbler peripheries. Rotation of the dial through small arcs in opposite directions from this position will bring the opposite surfaces of the drive cam gate into contact with the fence lever nose. The points at which the fence lever nose contacts these opposite surfaces at the entrance to the drive cam gate are known as the left and right contact points of the fence lever and may be detected by coordination of the senses of touch and sight by the person manipulating the dial. A variation in the angular distance between and "feel" of these contact points occurs when one of the tumbler gates is positioned beneath the fence, which is distinguishable from the angular distance between and "feel" of these contact points when all of the tumbler gates are out of registry with the fence. Because of the fact that the drive cam can be rotated through a sufficient arc when the fence is in contact with the tumbler peripheries to reveal the contact points of the fence lever nose, the location of the three tumbler wheel gates can frequently be determined by unauthorized persons by following a well-known lock manipulation procedure. Various modifications in combination locks structure have heretofore been resorted to to defeat detection of the lock combination in this manner. Among these is the lock structure disclosed in prior U.S. Pat. Nos. 2,575,674 and 2,807,954 granted to Harry C. Miller, wherein a guard or shielding slide is mounted on the rear face of the drive cam and has curved end portion conforming to the curvature of the drive cam periphery which normally overlaps the drive cam gate and forms a smooth continuation of the drive cam periphery to support the fence lever nose when the drive cam gate is in registry with the fence lever nose. An inner spindle extends through the dial spindle and is coupled at its inner end to the shielding slide at its outer end to a knob which is in exposed condition, whereby upon rotation of the knob and inner spindle, the slide may be shifted radially of the drive cam to expose the drive cam gate for reception of the fence lever nose. When the shielding slide is in projected position exposing the drive cam gate to entry of the fence lever nose, stop members on the lock casing are disposed in the path of movement of a portion of the slide to limit rotation of the drive cam to an extent which will prevent detection of contact points for the fence lever nose.

It has been determined, however, that the security of this lock may be adversely affected in time if the portion of the shielding slide which is projected beyond the drive cam periphery becomes worn, as by abrasion against adjacent surfaces of the lock casing. It is possible that the projected end surface of the shielding slide may become worn to a depth equal to the spacing of the fence from the tumbler wheel peripheries when the fence lever nose engages the driving cam periphery. In such a case, the slide may be only partially projected from the position wherein it shields the drive cam gate to lower the fence into contact with the tumbler peripheries and lower the fence lever nose into at least the entrance to the drive cam gate without projecting the slide sufficiently to permit the stop members to limit rotation of the drive cam. In this condition, the dial could be manipulated to permit sensing of the contact points and detection of the combination of the lock.

An object of the present invention, therefore, is the provision of a novel combination lock of the type having a mechanism which normally maintains the fence lever nose spaced out of contact with the driving cam periphery and the fence spaced out of contact with the tumbler wheel peripheries, and which may be operated to shift the fence lever into momentary engagement with the driving cam only when the driving cam is decoupled from the tumbler wheels to prevent surreptitious detection of the combination of the lock by unauthorized persons.

Another object of the present invention is the provision of a combination lock having over-center spring means which normally positions the fence and fence lever out of contact with the tumbler wheels and driving cam during manipulation of the driving cam to adjust the tumbler wheels to the positions determined by the combination of the lock, to prevent the feel and sound effects inherent in usual combination locks from assisting in unauthorized manipulation of the lock, wherein the over-center spring means is activated to shift the fence lever into coupled relation with the driving cam in a novel manner when the correct combination has been dialed.

Another object of the invention is the provision of a novel combination lock of the type described in the immediately preceding paragraph, wherein a spring activator device coupled to the fence lever normally maintains the fence lever in raised position out of contact with the driving cam and is activated momentarily by the driving cam in a special manner after the correct combination has been dialed to release stored energy to impel the fence lever and over-center spring means to shift the fence lever to unlocking position coupled with the driving cam.

Another object of the invention is the provision of a novel combination lock as described in the immediately preceding paragraph, including novel means for holding the fence and fence lever away from the tumbler wheels and driving cam and for releasing the spring activator to impel the fence toward the tumblers in response to shifting of the driving cam to an abnormal displaced position and for restoring the spring activator to a raised cocked condition by rotation of the driving cam.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 7:
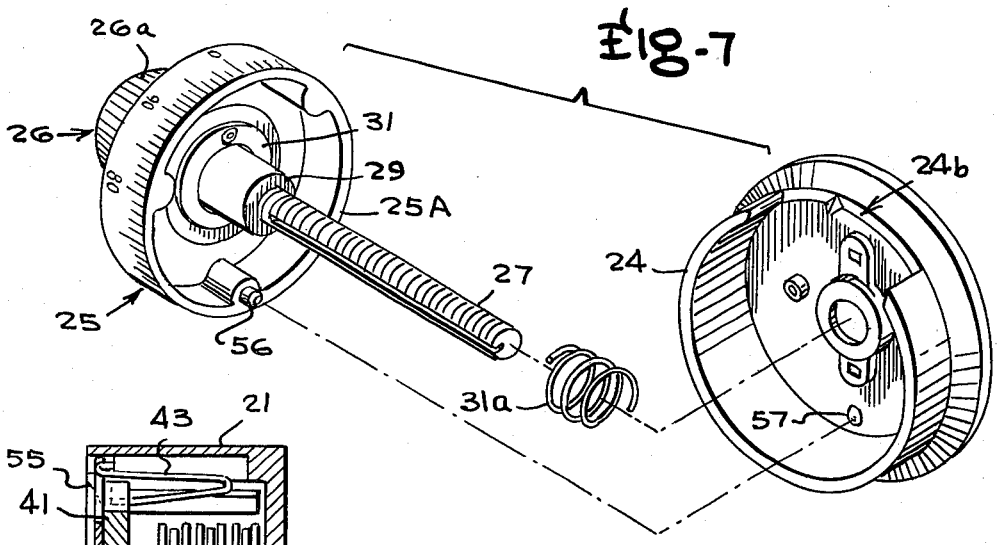
FIG. 7 is an exploded perspective view of the dial and dial ring and dial spindle components.

Referring to the drawings, wherein like reference characters designate corresponding parts throughout the several figures, there is illustrated a combination lock generally indicated by the reference character 20, which is of the general type disclosed in the prior U.S. Pat. Nos. 2,575,674 and 2,807,954 issued to Harry C. Miller. The combination lock comprises a substantially rectangular lock case 21 having a hollow boss 22 projecting inwardly from the front wall 23 thereof. The lock case 21 is designed to be mounted against the inner surface of a door or other closure in the conventional manner, as by mounting screws extending through screw holes near the corners of the lock case and into the supporting door. Secured to the outer face of the supporting door concentric with the axis of the hollow boss 22 is a dial ring 24, here shown as having a cylindrical shield **24*a* surrounding and shielding from view the major portion of the peripheral flange 25A of dial portion 25 of combination dial and knob 26, the shield 24*a* being interrupted by a sight opening 24*b*** of suitable circumferential extent.

The combination dial and knob 26 is supported for rotation within the forwardly opening cylindrical well of the dial ring 24 defined by the shield **24*a*, and is likewise supported for axial movement inwardly and outwardly of the dial ring, by means of a drive spindle 27 coupled at its outermost end to the dial and knob member 26 and extending through the hollow boss 22 on the front wall of the lock case 21 to be rotatably journalled by the boss and supported for axial movement therein. The combination dial and knob 26 has an integral knob portion 26*a* thereon which projects forwardly from the dial portion 25 and preferably has a knurled periphery to facilitate manipulation of the combination dial and knob 26**.

Figure 2:
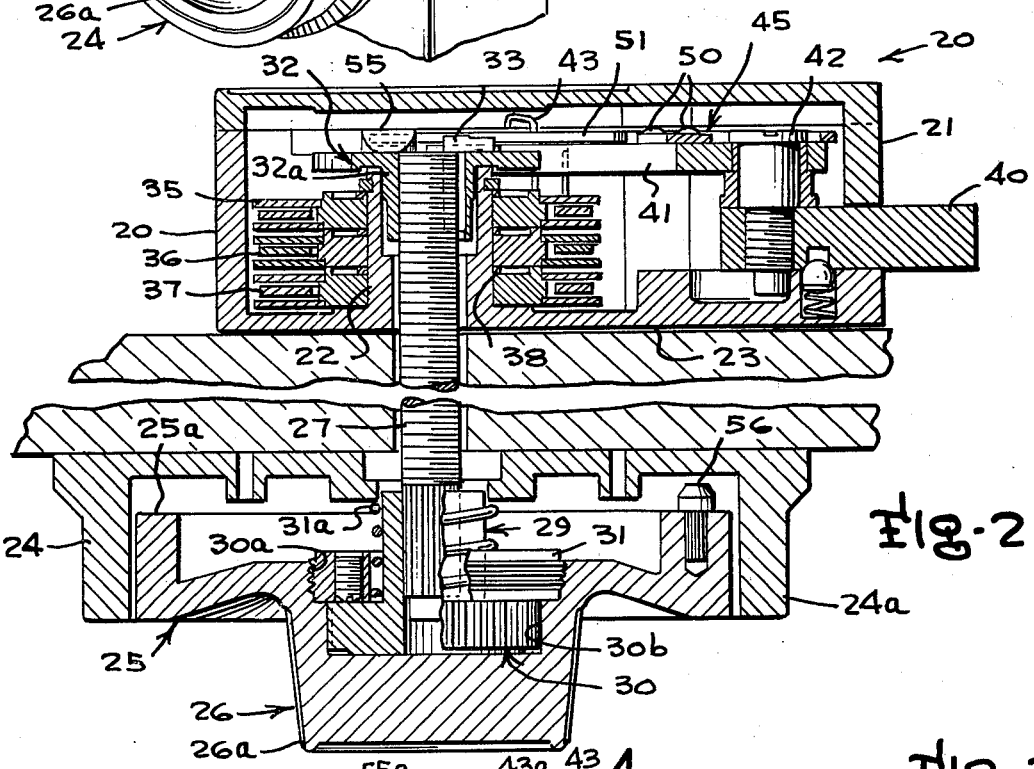
FIG. 2 is a horizontal section view of the combination lock, taken along the line 2—2 of FIG. 1.

The spindle 27 in the preferred embodiment is assembled to the combination dial and knob 26 by a coupling mechanism similar to that disclosed in prior U.S. Pat. No. 2,951,358 granted to Harry C. Miller, whereby the forward end portion of the spindle 27 is provided with a knurled cylindrical region which is driven into a central bore extending axially through a coupling bushing forming a serrated head adapted to interfit in a rearwardly facing serrated cylindrical well in the combination dial and knob member 26. The serrated head or coupling bushing 29 is provided with a constricted neck portion of sufficient length to accommodate the knurled end portion of the spindle 27 and has an enlarged diameter annular body portion providing an uninterrupted series of V-cut teeth extending about the periphery of the cylindrical enlarged diameter body portion, the teeth having radially outwardly pointing crests forming wedge formations extending in parallelism with the axis of the spindle 27. The serrated bushing or head 29 is removably coupled to the combination dial and knob at any of a plurality of angular positions by seating the enlarged diameter body portion of the serrated head 29 in a complimentary cylindrical bore or well formed in the rearwardly facing surface of the combination dial and knob member 26, which has an uninterrupted series of V-cut grooves along the cylindrical surface portion of the well complimenting the teeth of the serrated bushing or head 29. The bore, indicated by the reference character 30, includes an enlarged diameter bore portion **30*a* forming a threaded neck portion of the bore of larger diameter than the seat portion 30*b* having the V-cut grooves, and is designed to receive an annular retaining collar or hub 31 whose peripheral threads mate with the threads in the portion 30*a* of the bore 30. The retaining collar or hub 31 has a central bore of sufficient diameter to accommodate the smaller diameter neck portion of the serrated head or coupling bushing 29 and to also accommodate several turns of a coil spring 31*a* surrounding the neck portion of the coupling bushing or head 29 which bears against the forwardly facing base wall of the well of the dial ring in which the combination dial and knob 26 is accomodated and resiliently biases the combination dial and knob 26 to the outermost limit position illustrated in FIG. 2**.

The inner or rearmost end of the drive spindle 27 is threaded to receive an internally threaded portion of a tubular boss formation **32*a* projecting forwardly integrally from the driving cam 32, the driving cam being keyed to the drive spindle 27 at the desired angular position by inserting a suitable spline key 33** into a radial grove in the center bore of the driving cam which is aligned radially with a longitudinal spline extending forwardly from the rearmost end of the spindle through a desired length of the spindle.

A plurality of tumbler wheels, generally indicated by the reference characters 35, 36 and 37, are supported to rotate freely upon the portion of the hollow boss 22 projecting rearwardly from the front wall of the lock case 21. Each of the tumbler wheels 35, 36 and 37 are of the conventional type designed to be changed by means of a conventional resetting key to vary the combination of the lock, and to this end comprise an inner hub on each of which are supported a pair of annular discs having a tumbler gate or peripheral recess 35*a*, 36*a* and 37*a* therein. The outer annular discs are selectively locked against rotation relative to their supporting hubs by means of conventional locking arms or levers carried by and between the pairs of annular discs on each hub and engaging peripheral serrations or teeth on the hub to hold the annular discs at a selected angular position. Conventional flys 38, consisting of annular rings having an outwardly extending radial projection thereon are provided between the forwardmost and the intermediate tumbler wheels 37 and 36, and between the intermediate and rearmost tumbler wheels 36 and 35, to rotate in annular recesses provided in the adjacent faces of the inner hubs of the tumblers 37 and 36. The radial projections of the flys engage stops on the adjacent tumbler wheels to provide a lost motion driving connection between the tumbler wheels operatively associated with each fly. The rearmost tumbler wheel 35 is provided with a fly having an annular ring to surround it and ride freely on the hollow boss 22 and an outwardly radiating projection adapted to be engaged by the forwardly projecting drive pin 32*b* on the drive cam 32.

The lock is provided with a bolt 40 which is adapted to slide in a suitable guideway formed in one end wall of the lock case 21. The bolt 40 is operated by means of a fence lever 41 which is pivotly attached to to the bolt by means of a screw 42. The fence lever 41 is normally resiliently urged to the elevating position illustrated in FIG. 3 by the lever spring 43 having one leg extending through an anchor opening or socket in the fence lever 41 and another leg seated in a socket in the upper wall of the lock case, capable of being shifted in a manner to be later described from a normal upper over-center position maintaining the fence lever 41 raised out of engagement with the driving cam and tumblers and capable of movement to a lower over-center position only when the driving cam and tumbler wheels occupy the proper angular position for the established combination of the lock. The fence lever 41 is provided with a laterally projecting bar 44, commonly referred to as a fence, which projects along an axis parallel to the axis of drive spindle 27 and overlies peripheries of all of the tumbler wheels 35, 36 and 37. The fence 44 is adapted to be received in the peripheral gates 35*a*–37*a* of the tumbler wheels when the tumbler gates are disposed in registry with each other at a chosen angular position upon operation of the dial knob 26*a* to the proper opening combination of the lock. The downwardly rotation of the fence lever 41 achieved as hereinafter described when the fence 44 enters the peripheral gates of the three tumbler wheels and when the drive cam is disposed at a predetermined angular position permits the shoulder 41*a* on the free end of the lever 41 to fall free of the depending boss formation 21*a* on the upper wall of the lock case and permit the fence lever to be shifted laterally to the left of the boss formation 21*a* with reference to FIG. 5, to withdraw the bolt 40 from its projected or locking position.

The drive cam 32 is provided with a drive cam gate 32*c* adapted to receive the nose formation 41*b* of the fence lever 41. As will be observed from the illustration of the driving cam 32 in FIG. 2, the driving cam gate 32*c* has a pair of carefully shaped walls, one forming an inclined slightly convex wall portion for controlling the movement of the fence lever nose 41*b* into the driving cam gate and therefore controlling the speed of approach of the fence 44 toward the periphery tumbler wheels, and the other wall forming a shoulder for cooperating with a complementary shoulder on the fence lever nose to cause the fence lever to be shifted in a manner to retract the bolt 40 upon rotation of the drive cam in a counterclockwise direction as viewed in FIG. 5.

Figure 5:
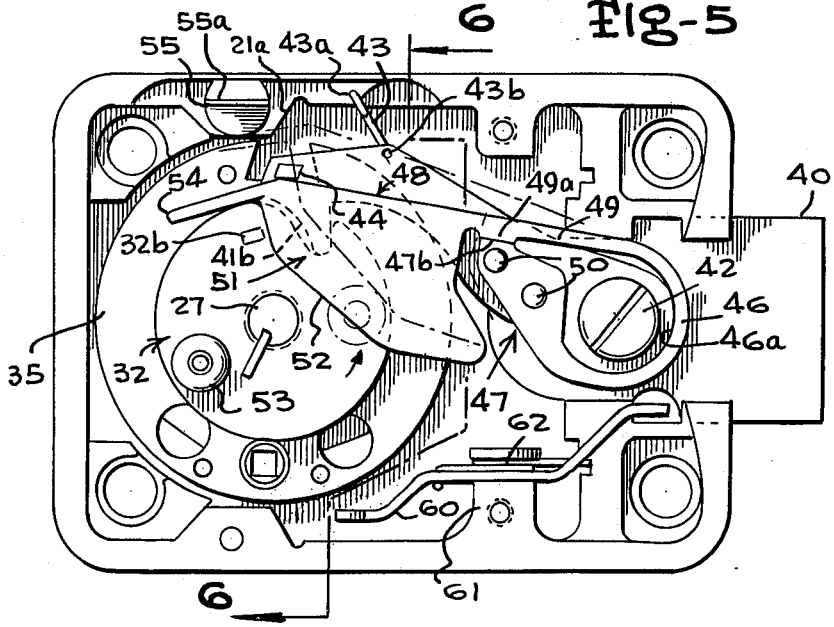
FIG. 5 is a rear elevation view similar to FIG. 3, but showing the fence lever released into coupled relation with the driving cam for unlocking the lock.
Figure 6:
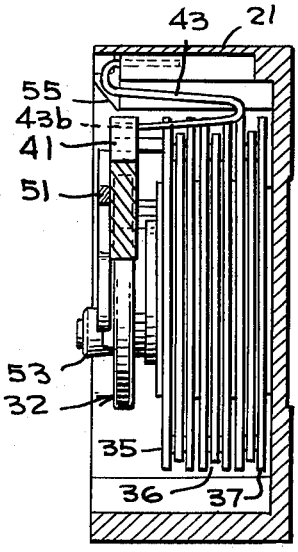
FIG. 6 is a vertical section view taken along the line 6—6 of FIG. 5.
Figure 1:
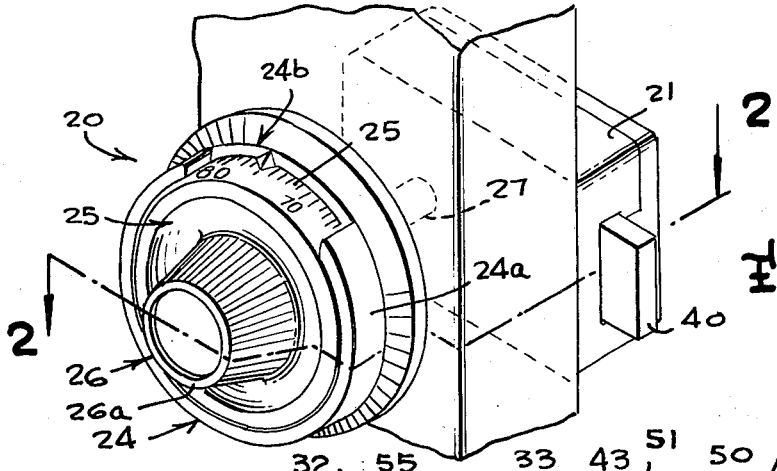
FIG. 1 is a perspective view of a combination lock constructed in accordance with the present invention.
Figure 3:
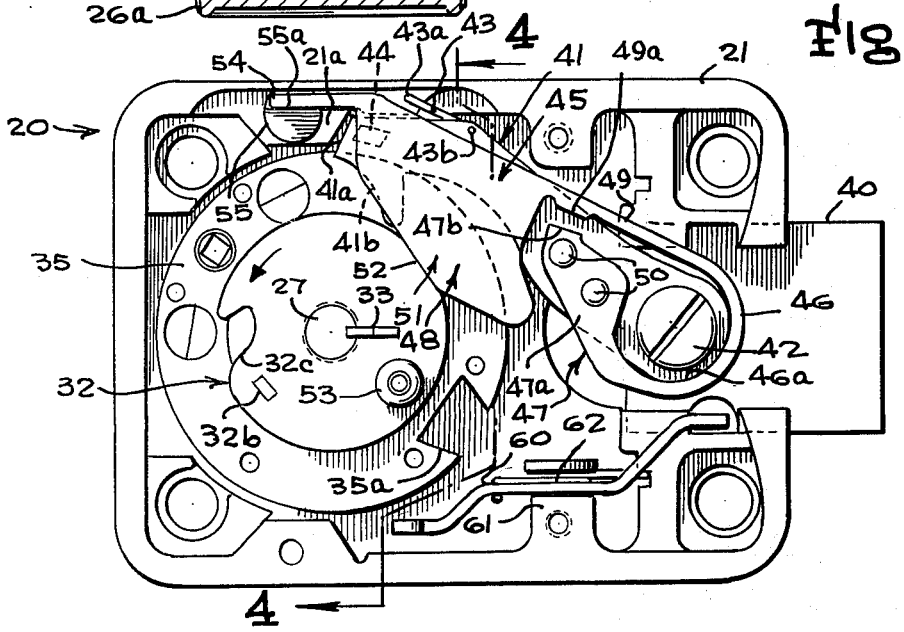
FIG. 3 is a rear elevation of the combination lock, with the rear cover removed, showing the lock in locked condition.

The mechanism of the present lock for normally maintaining the fence lever nose and fence out of contact with the driving cam and tumbler wheel peripheries to resist surreptitious detection of the lock combination comprises a spring-like lever actuator 45 illustrated in FIGS. 3 and 5, which is securely fixed to the fence lever 41 adjacent the rear face thereof and provides relatively moveable hammer and anvil portions interconnected by a spring formation. In the illustrated emmbodiment, the lever actuator member 45 has a recurved or generally U-shaped spring formation indicated at 46 which partially encircles the mounting screw 42 for the fence lever 41 and integrally joins at one end thereof a mounting end formation 47 shaped to provide the anvil portion and its other end the spring formation joins an enlarged abutment and cam formation 48. The portion of the U-shaped spring formation 46 extending from the mid-region of the "U" to the free end of the spring formation joining the extension 48 forms what may be termed a hammer arm section 49 of the spring. The mounting enlargement 47*a* is fixed to the fence lever 41 eccentric of but relatively near its pivot defined by the screw 42, by means of suitable fastening devices such as the rivets 50 and terminating in a flat upwardly facing surface indicated at 47*b* forming the anvil surface. The portion of the hammer arm section 49 of the spring immediately confronting and lying adjacent the anvil surface 47*b* is enlarged slightly and defines a hammer formation 49*a* terminating in a flat surface which confronts and is coextensive with the anvil surface 47*b*. Normally in the unstressed condition of the spring-like lever actuator 45, the surface of the hammer formation 49*a* is closely adjacent with the anvil surface 47*b*. It will be noted that the curved spring portion 46 surrounds an enlarged cut-out or opening 46*a* and encircles more than half the circumference of the pivot screw 42, with the curved spring portion 46 being free to flex to store up and release energy as hereinafter described.

The portions 48 of the lever actuator member 45 extending outwardly from the free end of the spring portion 46 and toward the free end of the fence lever 41 from the hammer formation 49*a* is made up of enlarged depending cam formation 51, which in the illustrated embodiments is of generally distorted triangular or fin-shaped configuration, defining an inclined cam surface 52 along a portion thereof confronting the center axis of the driving cam to be engaged by a rearwardly projecting roller 53 on the driving cam 32 when the lever actuator member 45 is in the lower released position shown in solid lines in FIG. 5. The free end portion of the lever actuator 45 terminated in the outwardly projecting latch finger 54 designed to releasably support the lever actuator member 45 and its associated fence lever 41 in an elevated inactive position, indicated in FIG. 3, by projecting into the space defined immediately above the upwardly facing latch shoulder surface 55*a* of the shoulder formation 55 carried by the casing 21 above the zone occupied by the tumbler wheels and driving cam. It will be noted that portions of the depending cam formation 51 adjacent to the inclined cam surface 52 rearwardly underlap a portion of the driving cam 32 so that rearward axial movement of the combined dial and knob 26 and the spindle 27 and driving cam interconnected therewith bring a portion of the rear surface of the driving cam 32 rearwardly against the depending cam formation 51 to resiliently distort it or displace it rearwardly from its normal elevated inactive position supported by the latch shoulder 55 through a sufficient distance to dislodge the finger 54 rearwardly from supported relation with the shoulder 55. This allows the abutment and cam formation portion 48 of the lever actuator 45 to spring downwardly through its normal unstressed position illustrated in FIG. 3 and through a slight amount of overtravel, causing the downwardly facing surface of the hammer formation 49*a* to impact with the surface of the anvil 47*b* and propel the fence lever 41 downwardly to a position momentarily engaging the fence 44 with the outer peripheries of the tumbler wheels.

Figure 4:
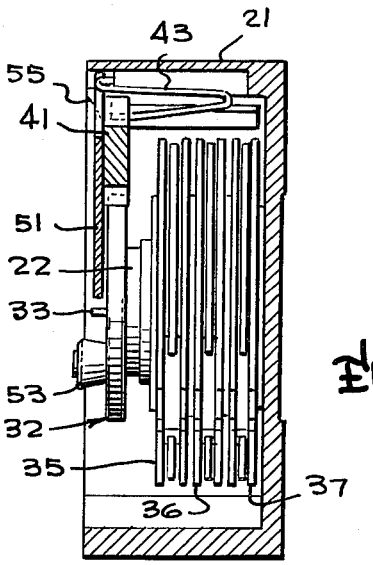
FIG. 4 is a vertical section view taken along the line 4—4 of FIG. 3.

The rearward axial displacement of the driving cam 32 and the dial and knob 26 that are connected therewith is permitted only when the dial is precisely at the zero position, by virtue of the dial stop stud 56 projecting rearwardly from the flange portion of the dial 25 which normally engages the confronting forwardly facing surface of the dial ring to prevent such rearward displacement of the dial knob. The stud 56 registers with and may be received in the forwardly facing recess 57 in the dial ring 24 to accommodate the desired rearward axial displacement of the dial and driving cam when the dial is at the zero position. At this zero position of the dial, the driving cam is disposed in an angular position wherein the driving cam gate 32*c* faces and is aligned to receive the fence lever nose 41*b*, thus permitting sufficient pivotal movement of the fence lever 41 to bring the fence 44 to a position to engage the tumbler peripheries. If the tumbler gates 35*a*, 36*a* and 37*a* are properly aligned with the fence, as a result of having dialed the proper combination, the impact forced produced by the hammer action of the formation 49*a* on the anvil 47*b* upon the above described release of the lever actuator 45 propels the fence lever downwardly to a position locating the fence 44 in the tumbler wheel gates, and during such fence lever movement the spring 43 shifts to an overcenter position disposing its lower leg 43*b* below the line interconnecting the centers of its upper leg 43*a* and the fence lever pivot screw 42 to thereby resiliently hold the fence lever 41 in the lowered position wherein its nose 41*b* is coupled in the driving cam recess 32*c*. At this position, the shoulder 41*a* at the free end of the fence lever 41 is displaced slightly below the stationary boss 21*a* depending from the upper wall of the case so that rotation of the dial from the zero position in a direction to rotate the drive cam 32 counterclockwise from the position illustrated in FIG. 5 for about 30° withdraws the fence lever 41 to the left as viewed in FIG. 4 and retracts the bolt 40 from its associated keeper.

The lock is preferably also provided with the usual relock lever 60 pivoted on the relock lever mounting post 61 and biased by the relock spring 62 in such direction as to pivot the relock lever in a direction to project a tongue on the end thereof adjacent to the bolt into a confronting recess in the bolt when the rear cover is removed from the lock case or when the lock cover is driven from the case in any manner during attempted forceable entry of the lock, to thereby lock the bolt against retraction.

Reviewing briefly the operation of the lock, assuming the lock to be in locked position with the tumbler wheels 35, 36 and 37 scrambled in a random fashion so that their gates are out of registry with the fence 44, the combination dial and knob 26 is rotated through at least three complete revolutions to a position disposing the dial number forming the first number of the lock combination of alignment with the fixed index mark 24*b* on the dial ring, which disposes the gate 37*a* of the forwardmost tumbler 37 in position to receive the fence 44. The dial and knob 26 is then rotated in a counterclockwise direction to move the lever on the dial 25 corresponding to the second number of the combination once past the fixed index mark 24*b* and a second time into alignment with the index 24*b*, and the dial then rotated in a clockwise direction again to bring the number corresponding to the third number of the lock combination into registry with the fixed index 24*b*. These last two manipulations successively bring the gate 36*a* of the tumbler wheel 36 and the gate 35*a* of tumbler wheel 35 into registry with the fence 44. The dial knob is then rotated counterclockwise through less than a complete revolution to bring the zero dial mark into registry with the fixed index mark 24*b*, thus registering the dial stop stud 56 with the accommodating recess 57 in the dial ring, and the dial and interconnected driving cam 32 are pushed rearwardly bringing a portion of the rear face of the driving cam 32 into contact with the depending formation 51 of the lever actuator 45 and forcing the same rearwardly. The spring portion 46 permits flexing of the lever actuator 45 rearwardly until the latch finger 54 is dislodged from supported relation by the shoulder formation 55. The enlarged cam formation portion 48 of the lever actuator 45 then springs downwardly due to the stored spring force in the stressed spring portion 46 and the overtravel from this downward return movement of the portion 48 and the adjoining hammer section 49 of previously resiliently stressed spring portion 46 impacts the hammer formation 49*a* with the anvil surface 47*b* and propels the fence lever 41 downwardly until the fence 44 is in position to contact the tumbler peripheries. If the tumbler wheel gates are all aligned with the fence 44, the fence lever 41 continues its downward travel to the release position illustrated in FIG. 5 wherein the fence lever nose 41*b* is intercoupled in the driving cam gate 32*c* so that rotation of the driving cam 32 in a counterclockwise direction from the FIG. 4 position retracts the bolt 40. If any of the tumbler wheel gates are not aligned with the fence 44, the fence 44 merely momentarily contacts the periphery of that misaligned tumbler wheel and returns under the return force of the spring 43 to the elevated position spacing the fence lever nose and fence out of contact with the driving cam and tumbler wheels.

After the bolt has been retracted, it can be returned to the projected locking position by merely rotating the driving cam 32 and dial clockwise, as viewed in FIG. 5, beyond the zero position whereby the fence lever 41 is returned to the raised position after the driving cam passes the zero position by reason of its nose 41*b* riding up the inclined right-hand surface of the driving cam gate 32*c* as viewed in FIG. 5. The driving cam and dial are then rotated in a counterclockwise direction as viewed in FIG. 4, whereupon during the first revolution of the driving cam the driving cam roller 53 engages the inclined cam surface 52 of the cam formation 51 and stresses the spring portion 46 and adjoining enlarged formation 48 of the lever actuator upwardly to force the latch finger portion 54 up the downward facing ramp portion of the shoulder 55 to a position to snap into supported relation resting on the upwardly facing shoulder surface 55*a*. The lock is then in locked position ready for unlocking by proper dialing of the correct combination.

It will be appreciated that the foregoing lock construction may be varied by eliminating the shoulder formation 55 and latch finger portion 54, and supporting the dial 25 and spindle 27 and driving cam 32 for rotation only but not for axial movement. In such case, the roller 53 on the driving cam 32 would engage the cam surface 52 of the actuator member or accelerator 45 once each revolution to raise the hammer portion 49 to the stressed position corresponding to the cocked position of the first embodiment, and the hammer portion would then be released suddenly when the roller 33 passes out of engagement with the cam surface 52 to impel the hammer formation against the anvil surface and propel the fence lever toward the tumbler wheel peripheries. If the tumbler wheel gates are properly alined to receive the fence 44, the fence lever shifts to the lower active position shown in FIG. 5 when the fence is thus propelled by the hammer impact on the anvil. If any of the tumbler wheel gates are out of alinement to receive the fence, the fence taps the misalined tumbler wheel periphery and is immediately returned by the over-center spring to the raised position of FIG. 3.

What is claimed is:

1. In a combination lock having a plurality of peripherally gated tumbler wheels loosely journalled for rotation about a common axis, a peripherally gated driving cam fixed on a spindle rotatable about said axis, a bolt movable between projected and retracted positions, a fence lever having a fence and a nose formation thereon, means pivotally connecting the fence lever to the bolt for arcuate movement between a raised inactive position spacing the fence and nose out of contact with the tumbler wheel and driving cam peripheries and a lowered active position locating the fence and nose in said gates, the driving cam being operatively coupled to said nose at said active position for retracting the bolt upon rotation of the driving cam, means providing a lost motion driving coupling between the driving cam and tumbler wheels for adjusting the angular positions of the tumbler wheels, and a rotatable dial on the spindle for rotating the driving cam to angularly adjust the tumbler wheels, and improvement comprising over-center spring means coupled to said fence lever normally positioned for holding the latter at said raised inactive position, a fence lever accelerator including an anvil surface portion and a hammer portion mounted on the fence lever with the hammer portion supported by a spring formation for relative movement between a stressed spring energy storage position spaced from said anvil surface portion and an impact position engaging the latter, the accelerator having an abutment formation extending into the path of movement of a portion of the driving cam providing means for shifting said hammer portion to the stressed position upon selective rotation of the driving cam, restraint means for releasably supporting said hammer portion at said stressed position, and means for releasing said hammer portion from such stressed position for rapid spring driven movement to impact against said anvil surface portion and impel the fence lever toward the driving cam to a position momentarily engaging the fence with the tumbler wheel peripheries, the over-center spring means being operative to continue urging the fence lever to said raised inactive position when the tumbler wheel gates are not aligned with the fence to immediately return the fence lever to said raised inactive position following the momentary engagement with a misaligned tumbler wheel periphery and the over-center spring means shifting to a position urging the fence lever to said lowered active position responsive to such impelling of the fence lever toward the driving cam when the tumblers are properly aligned therewith.

2. A combination lock as defined in claim 1, wherein said fence lever accelerator is an integral member having said anvil surface portion and said hammer portion interconnected by a narrow elongated curved spring portion forming the spring which stores the spring energy when the hammer portion is shifted to said stress position and releases the spring energy to impel the hammer portion toward said anvil surface portion.

3. A combination lock as defined in claim 2, wherein said spring portion is of substantially U-shaped configuration encircling the means pivotally connecting the fence lever to the bolt, and said anvil surface portion being formed on a mounting end portion of said fence lever accelerator fixed to the fence lever.

4. A combination lock as defined in claim 1, wherein said restraint means includes a latch formation projecting from said hammer portion a stationary shoulder formation for supporting said latch formation in releasable engagement therewith to restrain the hammer portion in said stressed position, the means operated by the drive cam for releasing said latch formation from said shoulder formation.

5. A combination lock as defined in claim 2, wherein said restraint means includes a latch formation projecting from said hammer portion a stationary shoulder formation for supporting said latch formation in releasable engagement therewith to restrain the hammer portion in said stressed position, and means operated by the drive cam for releasing said latch formation from said shoulder formation.

6. A combination lock as defined in claim 1, wherein the means for shifting said hammer portion to said stressed position includes a cam surface formation on said hammer portion of said accelerator an eccentric projection on said driving cam engagable with said cam portion once each revolution of the driving cam for mementarily raising the hammer portion to said stressed position and then releasing the same.

7. A combination lock as defined in claim 2, wherein the means for shifting said hammer portion to said stressed position includes a cam surface formation on said hammer portion of said accelerator and an eccentric projection on said driving cam engagable with said cam portion once each revolution of the driving cam for momentarily raising the hammer portion to said stressed position and then releasing the same.

8. A combination lock as defined in claim 4, wherein said spindle and driving cam and dial are interconnected to form a spindle assembly supported for axial movement between a normal forward position and rearward position, and said fence lever accelerator having an abutment portion extending in the path of rearward axial movement of the driving cam from its forward position to its rearward position to be engaged by the driving cam and dislodge said latch formation from said stationary shoulder for spring driven impelling of the hammer portion to said impact position.

9. A combination lock as defined in claim 8, including a means for normally restraining said dial at said forward position at all but one predetermined angular position of the dial and accomodating movement of the dial to said rearward position and said predetermined angular position for shifting the driving cam into contact with the abutment portion to dislodge said latch formation.

10. In a combination lock having a plurality of peripherally gated tumbler wheels loosely journalled for rotation about a common axis, a peripherally gated driving cam fixed on a spindle supported for axial movement therewith between a normal forward position and rearward position and rotatable about said axis, a bolt movable between projected and retracted positions, a fence lever having a fence and a nose formation thereon, means pivotally connecting the fence lever to the bolt for arcuate movement between a raised inactive position spacing the fence and nose out of contact with the tumbler wheel and driving cam peripheries and a lowered active position locating the fence and nose in said gates, the driving cam being operatively coupled to said nose at said active position for retracating the bolt upon rotation of the driving cam, means providing a lost motion driving coupling between the driving cam and tumbler wheels for adjusting the angular positions of the tumbler wheels, a rotatable dial on the spindle for rotating the driving cam to angularly adjust the tumbler wheels, and means de-coupling said lost motion coupling when said driving cam occupies said rearward position, the improvement comprising over-center spring means coupled to said fence lever normally positioned for holding the fence lever at said raised inactive position, a fence lever accelerator including an anvil surface portion and a hammer portion mounted on the fence lever with the hammer portion supported by a spring formation for relative movement with respect to the anvil surface between a cocked position spaced from the anvil surface and an impact position engaging the anvil surface, the accelerator being in a stressed spring energy storage condition in said cocked position, means for shifting said hammer portion to said cocked position upon selected rotation of the driving cam, a latch formation on said accelerator, the lock having a stationary shoulder to be releasably engaged by the latch formation for releasably supporting the accelerator in said cocked position, the accelerator having an abutment formation extending into the path of rearward axial movement of a portion of the driving cam for dislodging the latch formation from said shoulder to release the hammer portion for rapid spring-driven movement from cocked position to impact against the anvil surface portion and impel the fence toward the driving cam to a position momentarily engaging the fence with the tumbler wheel peripheries, the over-center spring means being operative to continue urging the fence lever to said raised inactive position when the tumbler wheel gates are not aligned with the fence to immediately return the fence lever to said raised inactive position following the momentary engagement with a misaligned tumbler wheel periphery and the over-center spring means shifing to a position urging the fence lever to said lowered active position responsive to impelling of the fence lever toward the driving cam when the tumblers are properly aligned therewith.

11. A combination lock as defined in claim 10, wherein said fence lever accelerator is an integral member having said anvil surface portion and said hammer portion interconnected by a narrow elongated curved spring portion forming the spring which stores the spring energy when the hammer portion is shifted to said stress position and releases the spring energy to impel the hammer portion toward said anvil surface portion.

12. A combination lock as defined in claim 11, wherein said spring portion is of substantially U-shaped configuration encircling the means pivotally connecting the fence lever to the bolt, and said anvil surface portion being formed on a mounting end portion of said fence lever accelerator fixed to the fence lever.

13. A combination lock as defined in claim 10, wherein the means for shifting said hammer portion to said cocked position includes a cam surface formation on said hammer portion of said accelerator and an eccentric projection on said driving cam engagable with said cam portion during the first revolution of the driving cam for raising the hammer portion to said cocked position and engage the latch formation on said shoulder.

14. A combination lock as defined in claim 11, wherein the means for shifting said hammer portion to said cocked position includes a cam surface formation on said hammer portion of said accelerator and an eccentric projection on said driving cam engagable with said cam portion during the first revolution of the driving cam for raising the hammer portion to said cocked position and engage the latch formation on said shoulder.

15. A combination lock as defined in claim 10, including a means for normally restraining said dial at said forward position at all but one predetermined angular position of the dial and accomodating movement of the dial to said rearward position at said predetermined angular position for shifting the driving cam into contact with the abutment portion to dislodge said latch formation.

16. A combination lock as defined in claim 12, including a means for normally restraining said dial at said forward position at all but one predetermined angular position of the dial and accomodating movement of the dial to said rearward position at said predetermined angular position for shifting the driving cam into contact with the abutment portion to dislodge said latch formation.

17. A combination lock as defined in claim 13, including a means for normally restraining said dial at said forward position at all but one predetermined angular position of the dial and accomodating movement of the dial to said rearward position at said predetermined angular position for shifting the driving cam into contact with the abutment portion to dislodge said latch formation.

* * * * *